US007225479B2

(12) United States Patent
Katt

(10) Patent No.: US 7,225,479 B2
(45) Date of Patent: Jun. 5, 2007

(54) COVER SUPPORT FOR SPAS AND HOT TUBS

(76) Inventor: Samuel A. Katt, 15078 Carriageway, Spring Lake, MI (US) 49456

( * ) Notice: Subject to any disclaimer, the term of this patent is extended or adjusted under 35 U.S.C. 154(b) by 437 days.

(21) Appl. No.: 10/345,511

(22) Filed: Jan. 16, 2003

(65) Prior Publication Data

US 2003/0131402 A1 Jul. 17, 2003

Related U.S. Application Data

(60) Provisional application No. 60/367,936, filed on Mar. 27, 2002, provisional application No. 60/349,089, filed on Jan. 16, 2002.

(51) Int. Cl.
*E04H 4/00* (2006.01)

(52) U.S. Cl. ..... 4/498; 211/70.5; 248/309.1

(58) Field of Classification Search ..... 4/498; 114/364; 211/70.5; 224/402, 405, 406; 248/309.1

See application file for complete search history.

(56) References Cited

U.S. PATENT DOCUMENTS 3,701,436 A * 10/1972 Adams ..... 211/70.5
4,858,802 A * 8/1989 Hamby et al. ..... 224/406
4,991,238 A * 2/1991 Forrest ..... 4/498

* cited by examiner

*Primary Examiner*—Charles E. Phillips
(74) *Attorney, Agent, or Firm*—Price, Heneveld, Cooper, DeWitt & Litton, LLP

(57) ABSTRACT

A support mechanism for supporting a cover of a hot tub, according to the present invention, including a first cradle bracket for fixedly securing proximate an upper surface of the hot tub; and a second cradle bracket for fixedly securing proximate the upper surface of the hot tub at a location spaced from the first cradle bracket, wherein each of the first and second cradle brackets includes a substantially L-shaped recess for receiving and holding the cover when removed from across the top of the hot tub.

15 Claims, 3 Drawing Sheets

COVER SUPPORT FOR SPAS AND HOT TUBS

CROSS-REFERENCE TO RELATED APPLICATIONS

This application claims priority under 35 U.S.C: §119(e) to the following: U.S. Patent Provisional Application No. 60/367,936, entitled "HOT TUB COVER SUPPORT," filed on Mar. 27, 2002, by Samuel A. Katt; and U.S. Patent Provisional Application No. 60/349,089, entitled "HOT TUB COVER SUPPORT," filed on Jan. 16, 2002, by Samuel A. Katt. The disclosures of both of the above-referenced provisional applications are incorporated herein in their entirety.

BACKGROUND OF THE INVENTION

The present invention generally relates to a support mechanism for supporting a cover for spas and hot tubs.

Nearly all hot tubs and spas include a cover that is sufficiently sized to cover the entire opening of the hot tub while also being thermally insulated to prevent excessive heat loss from the water in the hot tub. Such covers are often bulky and difficult to handle. To ameliorate this problem, covers often include one or more hinges to allow the cover to be folded. Additionally, various mechanisms have been constructed for supporting the cover and enabling the cover to be pivoted relative to the hot tub. Some of these devices include complex spring-biased mechanisms and others include complicated and expensive hydraulics. Thus, the hot tub owner is typically faced with only two options—either attempting to manually remove and replace the cover while setting the cover on the ground in the vicinity of the hot tub each time the hot tub is utilized, or buying a rather expensive support mechanism that attaches to the hot tub and cover.

Thus, there exists a need for a hot tub cover support mechanism that is inexpensive and easy to utilize.

SUMMARY OF THE INVENTION

According to a first embodiment of the present invention, a support mechanism is provided for supporting a cover of a hot tub, where the support mechanism comprises: a first cradle bracket for fixedly securing proximate an upper surface of the hot tub; and a second cradle bracket for fixedly securing proximate the upper surface of the hot tub at a location spaced from the first cradle bracket, wherein each the first and second cradle brackets includes a substantially L-shaped recess for receiving and holding the cover when removed from across the top of the hot tub.

According to another embodiment, a cradle bracket is provided for use in supporting a cover proximate a hot tub, where the cradle bracket comprises: a horizontal leg extending outward from the upper surface of the hot tub; and a vertical leg extending substantially vertically upward from the horizontal leg at a slight angle back away from the hot tub, the vertical leg including a slot for receiving a safety strap for securing the cover to the cradle bracket.

According to another embodiment, a support mechanism is provided for supporting a cover of a hot tub, where the support mechanism comprises: a first cradle bracket for fixedly securing proximate an upper surface of the hot tub; a second cradle bracket for fixedly securing proximate the upper surface of the hot tub at a location spaced from the first cradle bracket; and a safety strap secured to the cradle brackets for releasably securing the cover to the cradle brackets. Each of the first and second cradle brackets comprises: a horizontal leg extending outward from the upper surface of the hot tub; a vertical leg extending substantially vertically upward from the horizontal leg at a slight angle back away from the hot tub, the vertical leg and the horizontal leg are joined at an angle of substantially 90 degrees to define a substantially L-shaped recess for receiving and holding the cover when removed from across the top of the hot tub, the vertical leg including a slot for receiving the safety strap; a mounting leg for mounting the cradle bracket proximate the hot tub, wherein the horizontal leg is attached to one end of the mounting leg, the horizontal leg extends outwardly at a slight downward angle from the mounting leg; and a strut extending between the mounting leg and the horizontal leg.

These and other features, advantages, and objects of the present invention will be further understood and appreciated by those skilled in the art by reference to the following specification, claims, and appended drawings.

DETAILED DESCRIPTION OF THE INVENTION

Figure 1:
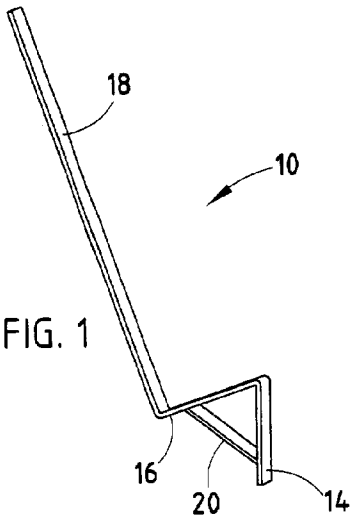
FIG. 1 is a perspective view of a cover support mechanism constructed in accordance with a first embodiment of the present invention.
Figure 2:
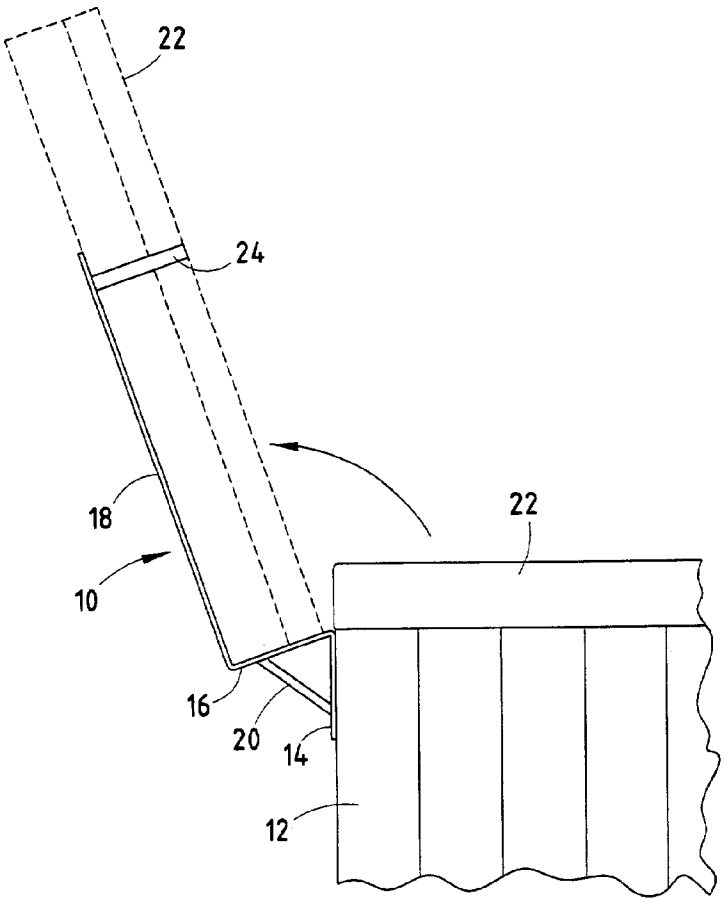
FIG. 2 is an elevational side view of a portion of a hot tub and the cover support mechanism constructed in accordance with the first embodiment of the present invention.
Figure 3:
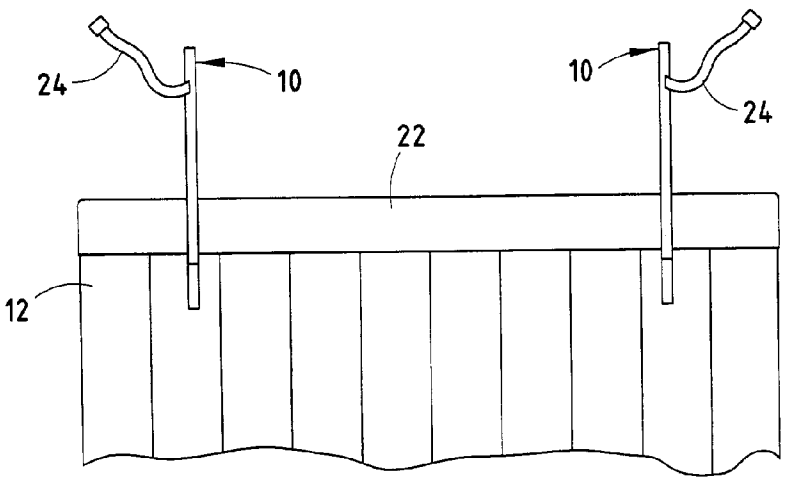
FIG. 3 is an elevational rear view of the hot tub and the cover support mechanism shown in FIG. 2 with the cover extending over the top of the hot tub.
Figure 5:
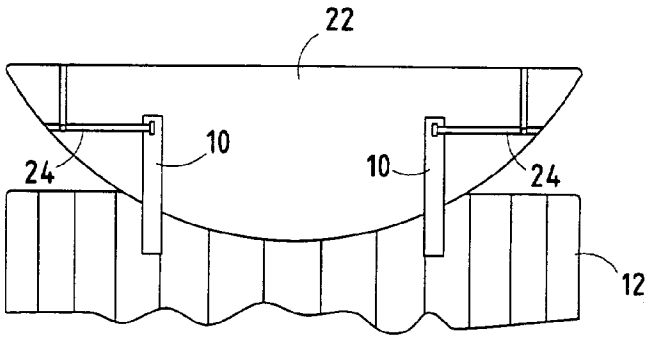
FIG. 5 is an elevational rear view of the round hot tub and the cover support mechanism shown in FIG. 4.
Figure 7:
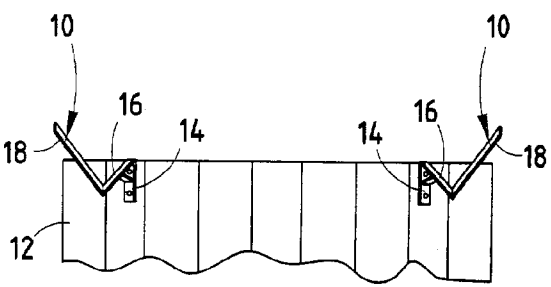
FIG. 7 is a perspective view showing the rear of the round hot tub and the cover support mechanism shown in FIGS. 4–6.
Figure 4:
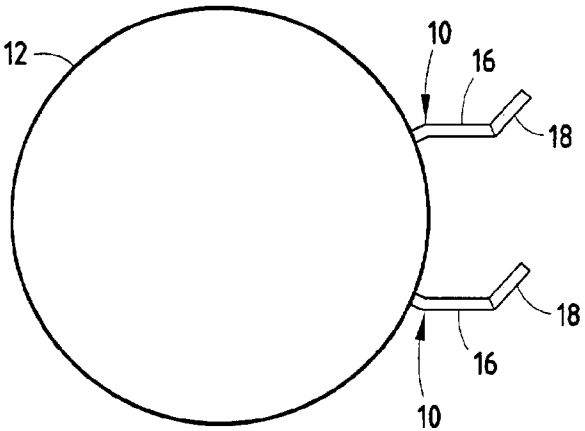
FIG. 4 is a plan view showing the top of a round hot tub having the cover support mechanism of a second embodiment of the present invention.
Figure 6:
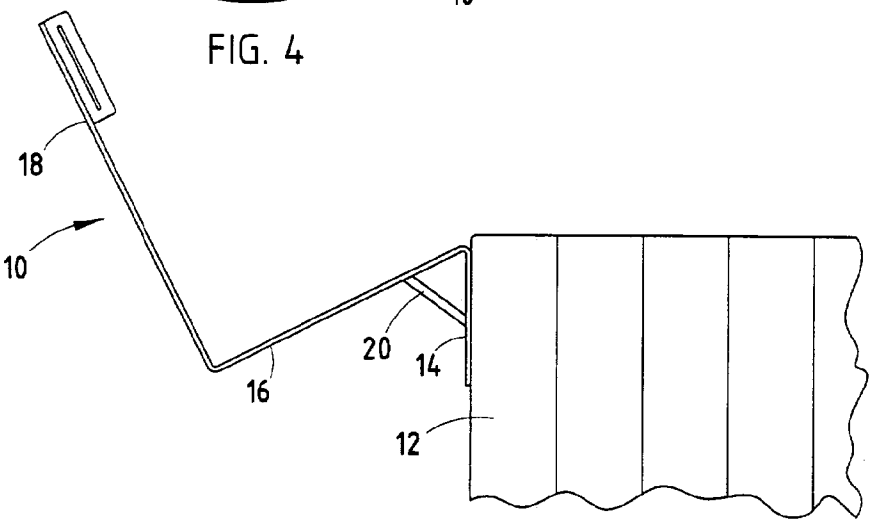
FIG. 6 is an elevational side view of a portion of the round hot tub and the cover support mechanism shown in FIGS. 4 and 5.

The present invention relates to a cover support mechanism for receiving and supporting the cover of a hot tub or spa. As used hereinafter, the term "hot tub" shall be construed to cover all forms of spas, tubs, or small pools. As shown in FIGS. 1–3, the cover support mechanism of the present invention includes a pair of cradle brackets 10, which are spaced apart from one another and secured on one side of hot tub base 12 exterior in the manner discussed further below and shown in FIG. 3. Each cradle bracket 10 includes a mounting leg 14, which is mounted to the hot tub base 12. Mounting leg 14 preferably extends vertically upward with its upper extent being proximate the top of the hot tub base 12. Mounting leg 14 is preferably 9 inches long.

It will be appreciated, however, that the various elements may have different dimensions as may be suitable for any particular application.

Each cradle bracket support 10 further includes an L-shaped member that extends from the uppermost extent of mounting leg 14 at an angle. Specifically, the L-shaped member includes a horizontal leg 16, which extends slightly downward from the upper extent of horizontal leg 16 and is preferably about 9 inches long. Accordingly, the angle between legs 14 and 16 is less than 90 degrees. The L-shaped member further includes a vertical leg 18, which is joined to the opposite end of horizontal leg 16 at approximately a 90-degree angle so as to extend substantially vertically but at a slightly inclined angle away from the hot tub. The vertical and horizontal legs thus defining an L-shaped recess in which the cover may be received, supported, and stored when removed from across the top of the hot tub. A strut 20 may be disposed between legs 14 and 16 to ensure appropriate mechanical support for the weight to be born by the cradle brackets 10. Specifically, as shown in FIG. 2, a user would fold the cover 22 and simply pivot it from the edge of hot tub base 12 into cradle brackets 10 with the weight of the cover being distributed across both horizontal leg 16 and vertical leg 18. Safety straps 24, which are secured to the uppermost ends of vertical legs 18, may then be strapped around the cover and joined to one another to ensure cover 22 does not subsequently fall back on the hot tub and its occupants.

The present invention thus allows the cover 22 to be stowed off the ground, which subsequently allows the user to more easily replace the cover 22 on hot tub 12 without having to lift the cover from the ground. Instead, the user simply unfastens safety straps 24 and pivots cover 22 back downward and then unfolds the cover over the hot tub base 12.

Another benefit of stowing the hot tub cover 22 in this manner is that it provides a privacy shield for the occupants within the hot tub.

The cradle support brackets 10 are preferably made with ⅜ inch by 1¼ inch flat stock (cold roll). The brackets may be mounted to the tub with six #12×1¼ inch stainless steel screws.

FIGS. 4 through 7 illustrate a second embodiment of the present invention whereby the cradle support brackets 10 are mounted on a round hot tub 12 for holding a round cover 22. Here, the cradle support brackets 10 are preferably made out of 1¼ inch by ⅝ inch flat stock with 1 inch nylon strapping to serve as straps 24. In this embodiment, mounting legs 14 are approximately 9 inches long, horizontal legs 16 are approximately 12 inches long, and vertical leg 18 is approximately 18 inches long and terminates at its distal end with a slot that is 1¼ inches and ⅜ inch wide for receiving an end of strap 24. The mounting legs 14 may be angled to match the roundness of the hot tub base 12 at approximately 15 degrees or whatever angle would be required so that the mounting legs 14 are flush against the sides of base 12, preferably angled such that horizontal legs 16 are parallel to one another. The brackets are preferably mounted 20 inches off center for a total separation distance of 40 inches. This distance may vary depending upon the size of hot tub base 12. Like the first embodiment, horizontal legs 16 are preferably inclined downward such that they form less than a 90 degree angle with mounting legs 14. A strut 20 made of 1 inch by ⅛ inch flat stock is disposed between mounting leg 14 and horizontal leg 16 to support the weight of cover 22 when mounted on cradle support brackets 10.

Figure 9:
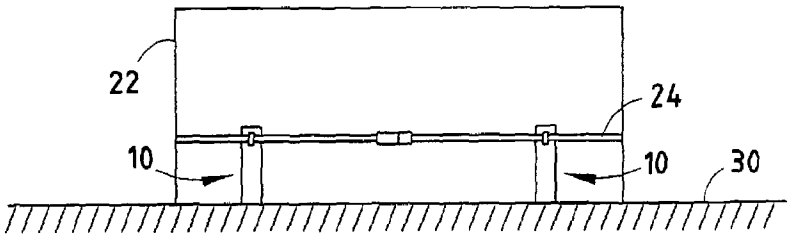
FIG. 9 is an elevational rear view of the hot tub and the cover support mechanism shown in FIG. 8.
Figure 10:
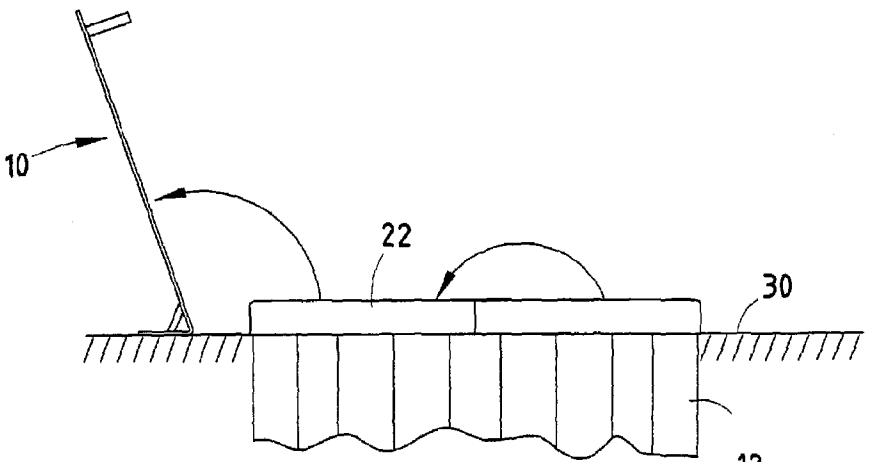
FIG. 10 is an elevational side view of the hot tub and the cover support mechanism shown in FIGS. 8 and 9.
Figure 8:
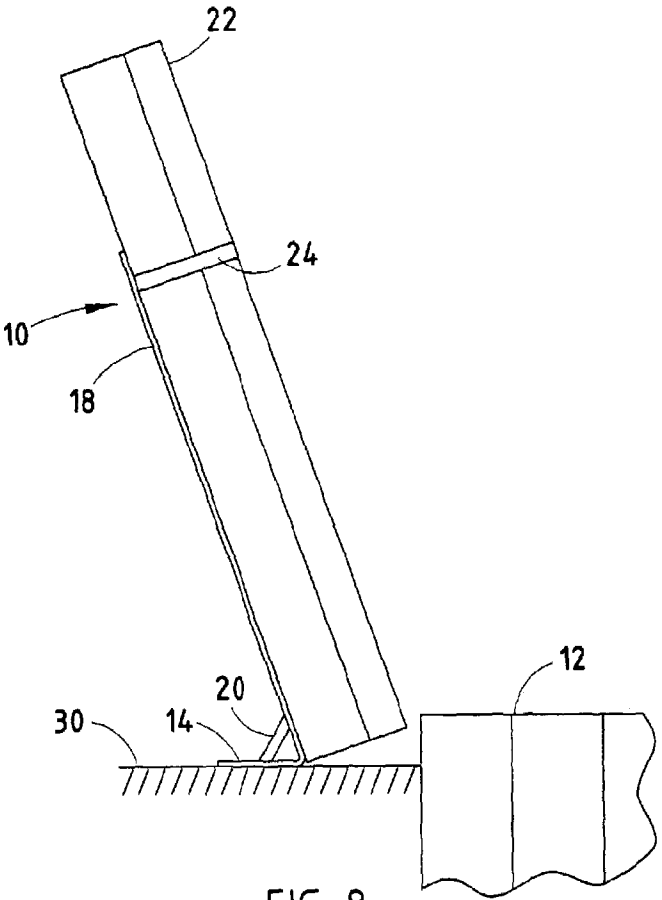
FIG. 8 is an elevational side view of a portion of an in-deck mounted hot tub and the cover support mechanism of a third embodiment of the present invention.

A third embodiment of the present invention is shown in FIGS. 8 through 10. This embodiment is designed for a hot tub mounted in a deck 30. In this embodiment, the mounting legs 14 are horizontal and are mounted to the upper surface of deck 30. The horizontal leg 16 may be eliminated with vertical legs 18 extending from the end of mounting legs 14 that are closest to hot tub 12. A strut 20 may be provided between mounting leg 14 and vertical leg 18. Vertical leg 18 is preferably inclined such that the angle between legs 14 and 18 is less than 90 degrees. Similar to the other embodiments, a strap 24 is provided that extends around the hot tub cover and which preferably extends through slots formed in the vertical legs 18 of brackets 10.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A support mechanism for vertically supporting a cover of a hot tub, the cover having a top surface surrounded by at least one edge surface, the support mechanism comprising:

a first cradle bracket for fixedly securing proximate an upper surface of the hot tub; and a second cradle bracket for fixedly securing proximate the upper surface of the hot tub at a location spaced from said first cradle bracket, wherein each said first and second cradle brackets includes a substantially L-shaped recess for receiving and holding the cover when removed from across the top of the hot tub, wherein each cradle bracket comprises a horizontal leg extending substantially horizontally outward from the upper surface of the hot tub, and a vertical leg extending substantially vertically upward from said horizontal leg, said vertical and horizontal legs forming the L-shaped recess with said vertical leg having a greater length than said horizontal leg so as to contact the top surface of the cover when the cover is set vertically on an edge surface with the edge surface contacting said horizontal leg, wherein said vertical leg is angled back away from the hot tub about 15 degrees from vertical, and wherein said vertical and horizontal legs are joined at an angle of substantially 90 degrees.

2. The support mechanism of claim 1, wherein said cradle brackets each further comprise a mounting leg for mounting said cradle brackets proximate the hot tub.

3. The support mechanism of claim 2, wherein said horizontal leg extends substantially horizontally from said mounting leg away from the hot tub.

4. A support mechanism for vertically supporting a cover of a hot tub, the cover having a top surface surrounded by at least one edge surface, the support mechanism comprising:

a first cradle bracket for fixedly securing proximate an upper surface of the hot tub; and a second cradle bracket for fixedly securing proximate the upper surface of the hot tub at a location spaced from said first cradle bracket, wherein each said first and second cradle brackets includes a substantially L-shaped recess for receiving and holding the cover when removed from across the top of the hot tub, wherein each cradle bracket comprises a horizontal leg extending substantially horizontally outward from the upper surface of the hot tub, and a vertical leg extending substantially vertically upward from said horizontal leg, said vertical and horizontal legs forming the L-shaped recess with said vertical leg having a greater length than said horizontal leg so as to contact the top surface of the cover when the cover is set vertically on an edge surface with the edge surface contacting said horizontal leg, wherein said cradle brackets each further comprise a mounting leg for mounting said cradle brackets proximate the hot tub, wherein said horizontal leg extends substantially horizontally from said mounting leg away from the hot tub, and wherein said horizontal leg attached to one end of said mounting leg, said horizontal leg extends outwardly at a slight downward angle from said mounting leg.

5. The support mechanism of claim 4, wherein said slight downward angle is about 15 degrees.

6. The support mechanism of claim 5, wherein said vertical leg extends upward from an end of said horizontal leg opposite that end to which said mounting leg is attached, said vertical leg angled slightly back away from the hot tub.

7. The support mechanism of claim 4, wherein each of said cradle brackets further comprises a strut extending between said mounting leg and said horizontal leg.

8. The support mechanism of claim 4, wherein said vertical and horizontal legs being joined at an angle of substantially 90 degrees.

9. The support mechanism of claim 8, wherein said vertical leg is angled back away from the hot tub.

10. The support mechanism of claim 4, wherein said vertical leg is angled back away from the hot tub.

11. A cradle bracket for use in supporting a cover proximate a hot tub, the cradle bracket comprising:

a horizontal leg extending outward from the upper surface of the hot tub;

a vertical leg extending substantially vertically upward from said horizontal leg at a slight angle back away from the hot tub;

a safety strap secured to said vertical leg for releasably securing the cover to said vertical leg; and a mounting leg for mounting the cradle bracket proximate the hot tub, wherein said horizontal leg is attached to one end of said mounting leg, said horizontal leg extends outwardly at a slight downward angle from said mounting leg.

12. The cradle bracket of claim 11, wherein said slight downward angle is about 15 degrees.

13. A cradle bracket for use in supporting a cover proximate a hot tub, the cradle bracket comprising:

a horizontal leg extending outward from the upper surface of the hot tub;

a vertical leg extending substantially vertically upward from said horizontal leg at a slight angle back away from the hot tub; and a safety strap secured to said vertical leg for releasably securing the cover to said vertical leg, wherein each of said cradle brackets further comprises a strut extending between said mounting leg and said horizontal leg.

14. A support mechanism for supporting a cover of a hot tub, the support mechanism comprising:

a first cradle bracket for fixedly securing proximate an upper surface of the hot tub;

a second cradle bracket for fixedly securing proximate the upper surface of the hot tub at a location spaced from said first cradle bracket; and at least one safety strap secured to said cradle brackets for releasably securing the cover to said cradle brackets, wherein each said first and second cradle brackets comprises:

a horizontal leg extending outward from the upper surface of the hot tub;

a vertical leg extending substantially vertically upward from said horizontal leg at a slight angle back away from the hot tub, said vertical leg and said horizontal leg are joined at an angle of substantially 90 degrees to define a substantially L-shaped recess for receiving and holding the cover when removed from across the top of the hot tub, said vertical leg including a slot for receiving said safety strap;

a mounting leg for mounting the cradle bracket proximate the hot tub, wherein said horizontal leg is attached to one end of said mounting leg, said horizontal leg extends outwardly at a slight downward angle from said mounting leg; and a strut extending between said mounting leg and said horizontal leg.

15. The support mechanism of claim 14, wherein said at least one safety strap includes two safety straps.

* * * * *